US005079983A

United States Patent [19]

Bruhn

[11] Patent Number: 5,079,983

[45] Date of Patent: Jan. 14, 1992

[54] REPLACEABLE HEAD FOR MAGNETIC REPULSION PUNCH

[75] Inventor: Peter H. Bruhn, Georgetown, Tex.

[73] Assignee: International Business Machines Corporation, Armonk, N.Y.

[21] Appl. No.: 520,434

[22] Filed: May 8, 1990

[51] Int. Cl.[5] ..... B26D 5/08

[52] U.S. Cl. ..... 83/575; 227/131

[58] Field of Search ..... 83/575, 576, 577, 100; 234/107, 108; 227/131

[56] References Cited

U.S. PATENT DOCUMENTS

| | | | |
|---|---|---|---|
| 3,141,171 | 7/1964 | Doyle et al. | 227/131 X |
| 4,821,614 | 4/1989 | Fleet et al. | 83/575 X |
| 4,872,381 | 10/1989 | Stroms | 83/575 X |
| 4,934,236 | 6/1990 | Gordon | 83/575 X |

*Primary Examiner*—Z. R. Bilinsky
*Attorney, Agent, or Firm*—Robert M. Carwell

[57] ABSTRACT

A punch holder has brazed thereon a copper disk and receives a punch extending therethrough. The holder is in registry with an upper punch guide/punch downstop and has a spring extending therethrough for controlling axial movement of the punch. A lower punch guide and stripper bushing also receive and guide the punch in coaxial alignment therewith. In operation, a magnetically energized coil repulses the disk, which, in turn, imparts downward punching force to the punch with the spring providing restorative force. The disk is fully supported by the punch holder substantially along its radius, thereby preventing distortion. The spring provides constant force over the deflection range, thereby enhancing the punching action while improving reliability and reducing failures. Due to the punch being releasably attached to the punch holder-disk, it may be separately replaced. A sliding contact and aligning tolerance is provided only at opposing ends of the punch between the punch and the lower guide through which it extends at its distal end, and between the punch holder O.D. and upper punch guide I.D. at the proximal end. A repairable head is provided thereby avoiding previous practice of discarding entire defective head assemblies.

9 Claims, 3 Drawing Sheets

REPLACEABLE HEAD FOR MAGNETIC REPULSION PUNCH

DESCRIPTION

1. Technical Field

This invention relates to magnetic repulsion punching, and, more particularly, relates to an improved design for a replaceable punch head used for magnetic repulsion hole piercing and related hardware required to align, return and down-stop the punch.

2. Background Art

With the continued movement toward high-density electronic packaging and the concomitant requirement for placing increasingly smaller diameter holes through substrates and the like, techniques were developed for rapidly effecting such extremely minute holes which went beyond the limitations of conventional rotary drill bits. One such technique which has gained wide acceptance is magnetic repulsion hole piercing, which is now conventionally used to provide such high quality accurate small diameter holes in thin material and at a rapid rate. Thus, the state of the art has advanced to the point where hole diameters of 89 microns in 0.0025 inch thick soft copper sheets are being produced at rates of more than 50 holes per second.

In the conventional operation of such magnetic repulsion punch technology, a punch is provided having a copper disk associated therewith. Upon creation of a high intensity magnetic impulse field in an appropriate adjacent energizing coil, the copper disk can thus be repulsed therefrom whereby a high velocity is imparted to the punch. Upon the punch contacting the substrate, the desired hole is disposed therethrough. Although these minute punches are typically tungsten carbide material, which may produce over a million holes before requiring replacement, the process, nevertheless, consumes large quantities of such expensive punches whereby cost of punch replacement becomes a significant expense. However, as will be hereinafter described, due to the serious limitations in the design provided by the state of the art, upon occurrence of defects in such repulsion punch heads, it was the practice of the industry to simply discard the nonfunctioning head assembly in its entirety.

With reference to FIG. 1, there may be seen depicted therein a cross section of a typical conventional magnetic repulsion punch head assembly. In accordance with the present state of the art, a magnetic repulsion punch is typically constructed of a solid accurately ground tungsten carbide shaft 20 on which a punch diameter 21 is ground. The shaft of the punch 20 is brazed into a hardened and ground tool steel insert 22, onto which is also brazed a copper disk 23 whereby an integral unit is formed. Upon energization of an intense magnetic field, proximal to the copper disk 23 as, for example, by energizing a coil, the magnetic repulsion process is effected, whereby a high velocity is imparted to the punch 20.

As previously alluded to in the prior art, when the shaft of the punch 20 breaks or dulls or the copper disk 23 becomes distorted due to the tremendous repulsive forces, for example, it was the typical practice to replace the entire head assembly unit, it thus being not possible to salvage any of the components. One reason for the distortion of the copper head, which is relatively malleable was due to the fact that the steel insert 22 had a diameter substantially less than that of the copper disk 23. Accordingly, at locations such as 32 the copper disk was substantially unsupported. When the downward motion of the punch ceased due to bottoming-out on the punch stop, the inertia of the copper disk would continue in the direction of arrows 34, thereby causing permanent deformation of the disk 23. A serious consequence of this is that the impulse imparted to the punch by the coil 30 is related to the proximity of the disk 23 to the coil 30. If spaces 36 are present between the coil and the disk the magnetic coupling therebetween is weakened having a direct result in weakening the downward acceleration and force imparted to the punch.

Yet a further drawback of prior art designs related to a spring 24 provided to impart a restorative force counteracting the repulsive force imparted onto the disk and punch by the magnetic field. This spring 24 was typically designed to be relatively short with a small diameter and, accordingly, was highly stressed in operation and, thus, was also frequently required to be replaced. Yet additional serious problems with the prior art design of such magnetic repulsion heads related to further components associated with the assembly. In order to accurately position the punch shaft 20 in a guide bushing 25 and punch diameter 21 (provided in the stripper bushing 26 conventionally in such assemblies), extremely accurate tolerances were required to be maintained between the I.D. of the bore through the guide bushing 25 and the O.D. of the punch shaft 20. Moreover, this tolerance must be maintained all along the length of the shaft 20 because this is quite expensive given that the entire punch head assembly and bushing 25 were often disposed after becoming worn. In other words. extremely accurate concentricity of these diameters was required to be maintained all along the shaft. As an example, the typical designed maximum clearance between the outside diameter of the shaft 20 and the inside diameter of the guide bushing 25 was required to be held to no greater than 0.0025 mm. Accordingly, such design also resulted in expensive repulsion punch head assembly component costs since the resulting aspect ratio of the diameter and length of the hole was in excess of 10 to 1. It will be noted that in order to pierce a high quality hole in a soft copper substrate, for example, the punch 21 to dye 27 clearance of less than 0.0025 mm was required to be maintained.

For the foregoing reasons, an improved magnetic repulsion punch head assembly was highly sought after which could significantly reduce the cost of such an assembly while, at the same time, reducing equipment downtime, enhancing punch action and providing for more easily manufacturable and less expensive related dye components. Still further, due to the aforementioned problems associated with high impact forces and resultant deformation of the copper disk, a solution to this distortion which frequently occurred in prior art designs was sorely needed in the industry.

SUMMARY OF THE INVENTION

A punch holder has brazed thereon a copper disk and receives a punch extending therethrough. The holder is in registry with an upper punch guide/punch downstop and has a spring extending therethrough for controlling axial movement of the punch. A lower punch guide and stripper bushing also receive and guide the punch in coaxial alignment therewith. In operation, a magnetically energized coil repulses the disk, which, in turn, imparts downward punching force to the punch with the spring providing restorative force. The disk is fully supported by the punch holder substantially along its radius, thereby preventing distortion. The spring provides constant force over the deflection range, thereby enhancing the punching action while improving reliability and reducing failures. Due to the punch being releasably attached to the punch holder-disk it may be separately replaced. A sliding contact and aligning tolerance is provided only at opposing ends of the punch between the punch and the lower guide through which it extends at its distal end, and between the punch holder O.D. and upper punch guide I.D. at the proximal end. A repairable head is provided thereby avoiding previous practice of discarding entire defective head assemblies.

BRIEF DESCRIPTION OF THE DRAWING

The novel features believed to be characteristic of the invention are set forth in the appended claims. The invention itself, however, as well as other features and advantages thereof, will be best understood by reference to the following description of the preferred embodiment, when read in conjunction with the accompanying figures, wherein:

BEST MODE FOR CARRYING OUT THE INVENTION

Figure 2:
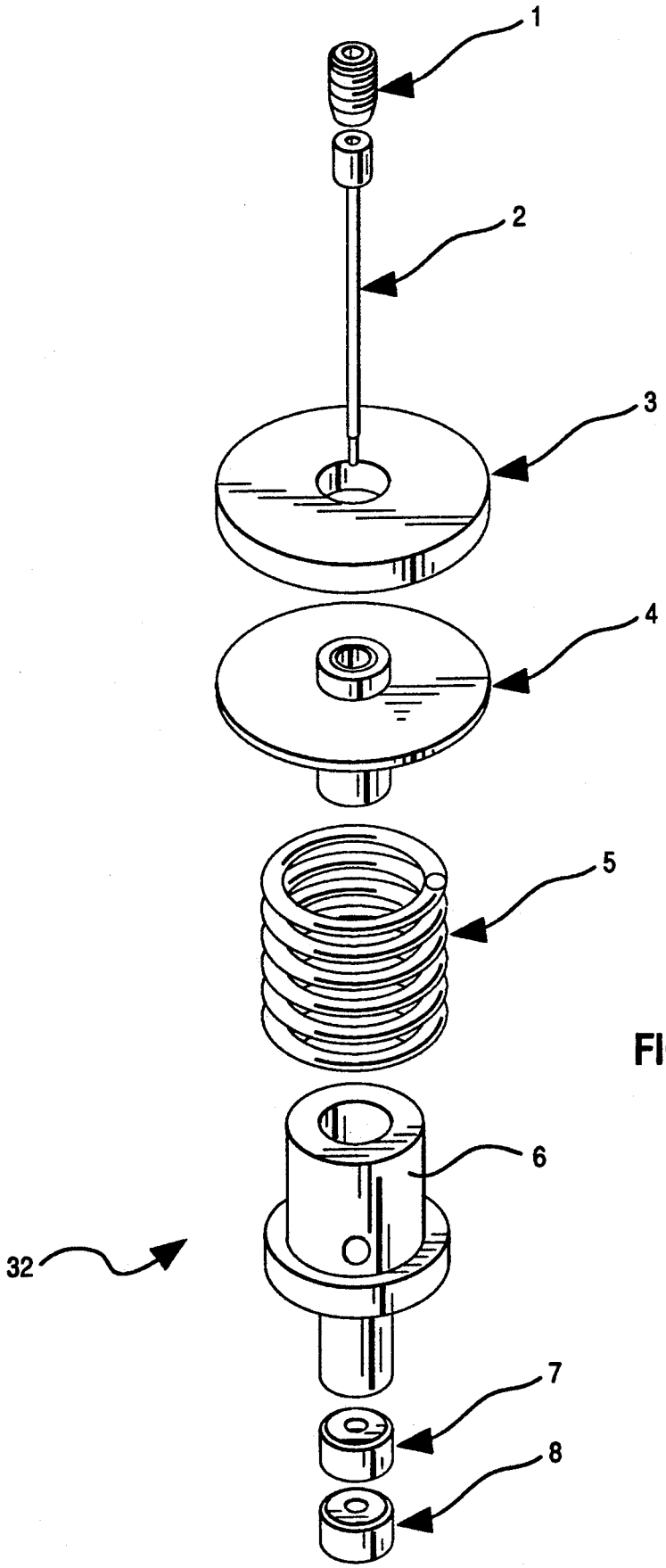
FIG. 2 is an exploded pictorial view of the replaceable magnetic repulsion punch of the present invention.
Figure 3:
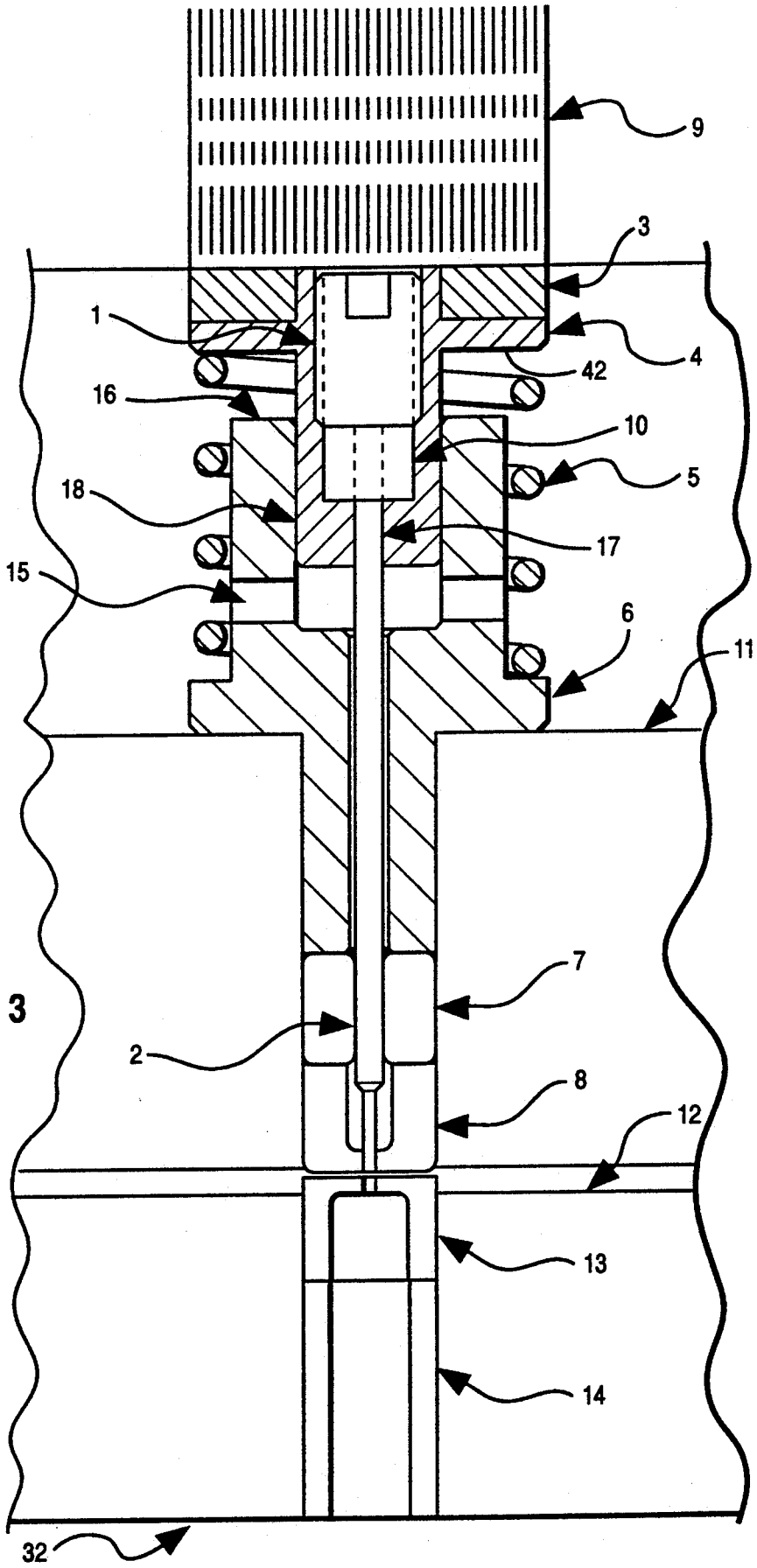
FIG. 3 is a side view of the repulsion punch of FIG. 2 in section.

First, with reference to FIGS. 2 and 3 an overall description of the magnetic repulsion punch, as depicted therein, will be provided. This will be followed by a more detailed description of the design and operation of the various components of the present invention.

Referring now to FIG. 3, the operation of the magnetic repulsion punch assembly 32 depicted therein is as follows. A copper punch disk 3 is held in contact with a magnetic repulsion coil 9 by a spring 5 when the punch is in the rest position. When the coil 9 is fired in a conventional manner by means of a coil power supply (not shown) a punch 2 is driven downward by the repulsive force of the magnetic field from the coil 9 imparting a repulsive force to the disk 3, thereby causing the punch 2 to pierce the desired substrate material.

The downward flight of the punch 2 causes the underside 42 of a punch holder 4 carrying disk 3 to strike an upper surface 16 on an upper punch guide 6, which, in turn, redirects this downward motion of the punch 2 upward by the impact in order to return it to the rest position. Due to the high energy forces achieved by the magnetic repulsion phenomenon, the punch cycle is typically completed in microseconds. The rebound force of the punch holder 4 against the down-stop provided by the surface 16 of the upper guide bushing 6 is the primary means of returning the punch 2 to the coil face of the coil 9. The spring, thus, only acts to hold the copper disk 3 against the coil face for good magnetic coupling to coil 9 to effect strong impulse motion on the disk 3, and to act as a damper so that the copper disk 3 will not rebound from the coil face.

Now that a general description of the overall operation of the repulsion punch has been provided, a more detailed description of the components thereof and operation will hereinafter follow with continued reference to FIGS. 2 and 3.

The aforementioned punch holder 4 is preferably an accurately machined, hardened and ground component onto which is brazed the copper disk 3 as required for the magnetic repulsion process. The punch 2 is preferably fashioned of a carbide steel onto which a soft steel head 10 is brazed, with the punch 2 being located axially in the punch holder 4 by an accurately machined diameter 17, with the punch 2 being held in place by a set screw 1. It will be noted that the punch head 10 does not require extremely accurate machining inasmuch as there is a clearance provided for in the punch holder 4.

Continuing with reference to FIGS. 2 and 3, it is a feature of the invention that the shaft diameter of the punch 2 which locates in diameter 17 will have preferably been reduced to one-half of conventional diameters in order to reduce the weight of the missile, which is an important consideration in effective magnetic repulsion and in the reduction of cost of the punch. It is a further important feature of the present invention to be noted that the punch holder 4 will preferably have a diameter substantially equal to that of the copper disk 3 whereby the disk 3 is fully supported by the hardened punch holder 4. This ensures that the copper will not distort in operation due to the extremely large impulse forces being exerted thereon, particularly on the outer edges of the disk and coil where the magnetic force is greatest. As was previously noted with respect to prior art, this distortion frequently occurred in prior designs necessitating discard of the entire head assembly. Moreover, it will be noted that by providing for the set screw 1 threadedly received by the punch holder 4 which retained the punch head 10 therewithin, it is possible with the present invention to remove the set screw 1 and, thus, the punch 2 with interconnected head 10 and replace the spent punch 2. This is contrast with the prior art of FIG. 1 wherein the entire assembly including the disk 23, disk holder 22 and punch 20 were an integral unit and must be discarded entirely, either due to deformation of the copper disk 23, wear on the punch head 21 or punch 20, or the like.

Figure 1:
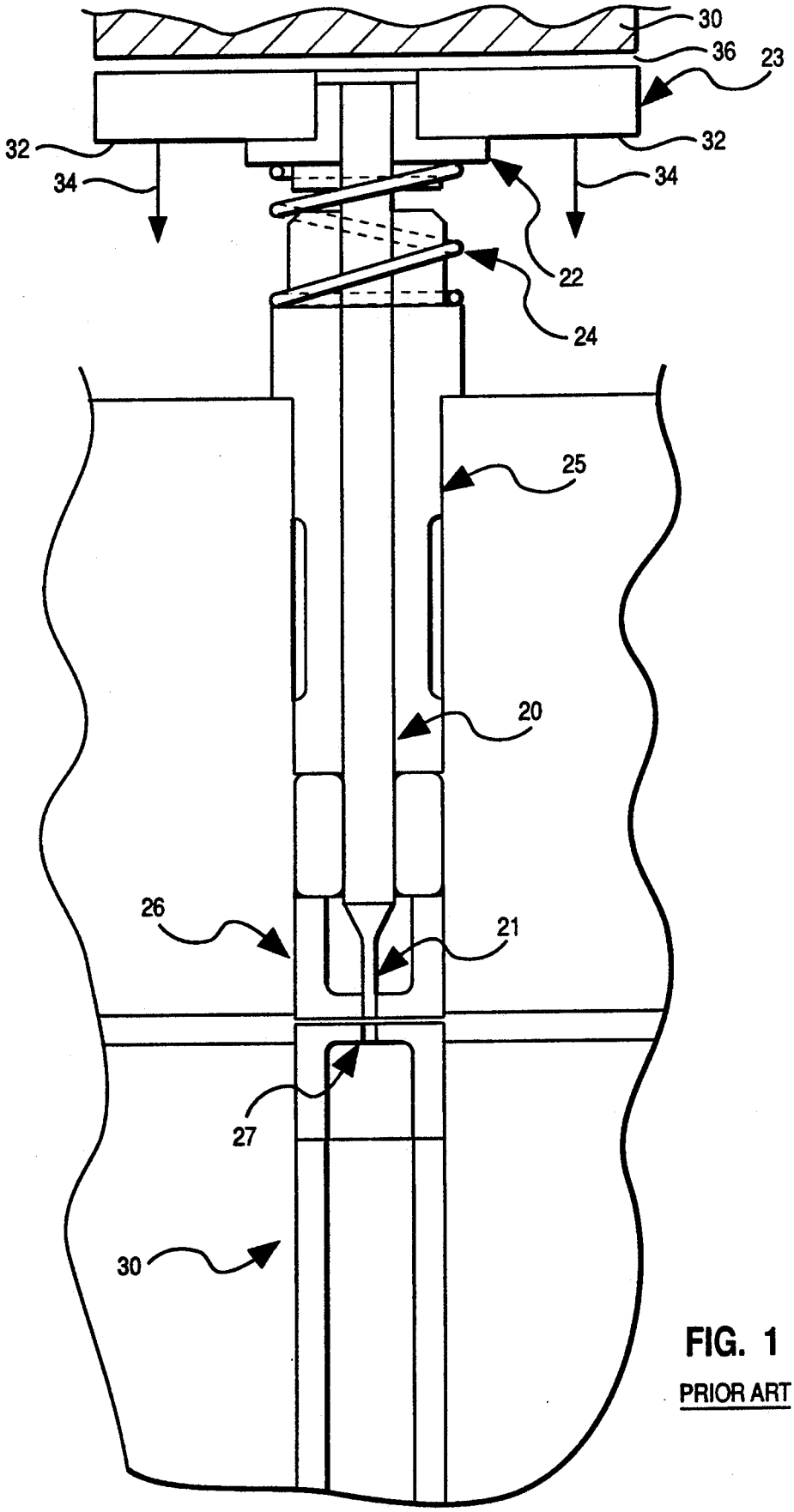
FIG. 1 PRIOR ART
FIG. 1 is an elevational view in section depicting a nonreplaceable magnetic repulsion punch of the prior art.

Yet another important feature of the invention may be observed by a comparison of the prior art of FIG. 1 with the invention of FIG. 3. It will be noted that in the prior art, the punch shaft 20 was in sliding engagement substantially along its entire length with a bore extending through the guide bushing 25. In order to maintain accurate horizontal placement, the I.D. of the bore in the bushing 25 must be maintained substantially close to the O.D. of the punch 20 substantially along the entire longitudinal access of the punch 20. This is an extremely expensive machining operation which is difficult to control, particularly given the aspect ratio of the punches. Moreover, sliding friction is encountered all along the length of this punch 20, which may cause binding and, thus, seriously detract from the punching ability if the tolerances are not accurately maintained.

In contrast, it will be noted from FIG. 3 that tight tolerances are only maintained at opposing ends of the punch 2. At the distal end, sliding engagement is provided between the O.D. of the punch 2 and the bore through the lower punch guide 7. However, through the intermediate portion of the punch 2, it is not in contact with the upper punch guide 6 in that the I.D. of the bore through the upper punch guide 6 is greater than that of the O.D. of the punch 2 to provide clearance. In that the punch head 10 is retained by the set screw 1 in the punch holder 4, the only tolerance at the upper end of the punch 2 which is of concern is between the bore through the upper punch guide 6 and the outer diameter of the lower cylinder extending from the punch holder 4. In this manner, the need to maintain close tolerances all along the length of the extremely small diameter punch 2 is obviated.

An upper punch guide 6 is further provided having a punch down-stop 7 portion extending radially outwards therefrom, this punch guide 6 preferably being a machined, hardened and ground component fashioned either of tool stool or carbide, depending on the application. It will be noted that the choice of carbide will typically provide for an increased duration over that of steel by a factor of 4, although being of significantly increased expense. The punch holder 4 is located in axial registry in the upper guide bushing 6 in diameter 18. The aspect ratio of diameter to length of this feature is preferably nominally 1 to 1.5 making it a relatively inexpensive operation to maintain. It will be noted at this point that the main shaft of punch 2 will have a clearance through the bushing 8. At the bottom of aperture 18, a plurality of cross-drilled holes 15 are provided which act as vents to prevent an air cushion from forming that would interfere with the flight of the punch. The lower punch guide bushing 7 also acts as a spacer for the stripper bushing 8. This lower guide bushing 7 may also be fashioned from either hardened tool steel or carbide as desired and will, preferably, have an aspect ratio of inside diameter to length of nominally 1 to 2. It will be further noted from FIG. 2 that the upper guide bushing 6, lower guide bushing 7, stripper bushing 8 and a die bushing 13 are in the same diameter hole which can be bored and thereby provide absolute alignment of all components when they are assembled.

Another important feature of the subject invention is that in the preferred embodiment, a spring 5, which is typically an extremely important component of such magnetic repulsion punch assemblies, will be optimized. It has been discovered that in operation, this spring 5 should have a constant force over its range of deflection. Accordingly, by increasing the diameter of this spring by a factor of 3 and increasing the length 2.5 times over such springs which might typically be encountered in the prior art, a spring design was accordingly provided which reduced the spring rate from 11.9 pounds per inch to 7.6 pounds per inch, thereby giving a more constant force over the operating range. It has been discovered that the original springs found in the prior art were highly stressed in operation, whereas the desired spring characteristics will bring it within operation in its optimum range, i.e. providing the aforementioned constant force over its range of deflection, thereby contributing substantially to a significantly reduced equipment downtime and enhanced punch action.

I claim:

1. A magnetic repulsion head assembly comprising, in coaxial alignment:

a repulsion disk;

a punch holder supporting said disk;

an upper punch guide;

a spring interconnected between said punch holder and said upper punch guide;

a lower punch guide; and a punch releasably attached to said punch holder;

wherein said punch holder defines a downwardly extending cylinder; and said upper punch guide defines a cylinder receiving said punch holder cylinder in sliding engagement therewith.

2. The apparatus of claim 1 wherein radially outermost portions of said disk and said punch holder are in vertical registry.

3. The apparatus of claim 2 wherein radially outermost portions of said spring are in vertical registry with said radially outermost portions of said disk and said punch holder.

4. The apparatus of claim 3 wherein said punch holder further includes an upwardly extending hollow cylinder extending through said disk; and wherein said punch further includes a punch shaft and a punch head interconnected to said shaft received within said hollow cylinder of said punch holder.

5. The apparatus of claim 4 wherein said cylinder of said upper punch guide, said disk and said punch holder define outer diameters of substantially equal magnitude.

6. The apparatus of claim 5 wherein said punch extends in coaxial alignment with and through a bore in said upper punch guide and is disengaged from a wall within said upper punch guide defining said bore.

7. The apparatus of claim 6 wherein said lower punch guide has a wall defining a bore therethrough in sliding engagement with a lower distal end of said punch.

8. The apparatus of claim 7 wherein said punch includes a punch head disposed on one end of said punch shaft releasably retained within said upwardly extending hollow cylinder of said punch holder.

9. The apparatus of claim 8 wherein said upwardly extending cylinder is threaded and said head assembly further includes a set screw threadedly received by said hollow cylinder of said punch holder for said releasable retention of said punch head within said punch holder cylinder.

* * * * *